US005959585A

United States Patent [19]

Militz

[11] Patent Number: 5,959,585

[45] Date of Patent: Sep. 28, 1999

[54] VEHICLE ANTENNA ARRANGEMENT AND AUXILIARY VEHICLE ANTENNA

[75] Inventor: Uwe Militz, Berlin, Germany

[73] Assignee: Robert Bosch GmbH, Stuttgart, Germany

[21] Appl. No.: 08/896,733

[22] PCT Filed: Nov. 21, 1996

[86] PCT No.: PCT/DE96/02221

§ 371 Date: Jul. 21, 1997

§ 102(e) Date: Jul. 21, 1997

[87] PCT Pub. No.: WO97/19487

PCT Pub. Date: May 29, 1997

[30] Foreign Application Priority Data

Nov. 23, 1995 [DE] Germany ..... 195 43 625

[51] Int. Cl.[6] ..... H01Q 1/32

[52] U.S. Cl. ..... 343/713; 343/725; 343/872

[58] Field of Search ..... 343/711, 712, 343/713, 725, 715, 700 MS, 872

[56] References Cited

U.S. PATENT DOCUMENTS

| | | | |
|---|---|---|---|
| 3,503,070 | 3/1970 | Kompfner | 343/713 |
| 4,868,577 | 9/1989 | Wingard | 343/725 |
| 5,146,232 | 9/1992 | Nishikawa et al. | 343/713 |
| 5,706,015 | 1/1998 | Chen et al. | 343/713 |
| 5,757,327 | 5/1998 | Yajima et al. | 343/713 |

FOREIGN PATENT DOCUMENTS

4005030C2 5/1994 Germany .

*Primary Examiner*—Don Wong
*Assistant Examiner*—Tan Ho
*Attorney, Agent, or Firm*—Michael J. Striker

[57] ABSTRACT

A vehicle antenna arrangement and an auxiliary vehicle antenna are proposed that enable a further antenna system (55) to be adapted to a vehicle antenna (2). The further antenna system (55) is accommodated in a housing (50) that is mounted on a retaining plate (35). The retaining plate (35) has a recess (40) and is mounted on a vehicle body (1). In the region of the recess (40), the vehicle body (1) has an aperture (20), through which a tube (15) is passed that is connected to a base plate (10) and an antenna base (5), mounted on it, of the vehicle antenna (2). The base plate (10) rests on the retaining plate (35) via protrusions (80). Two antenna cables (25) and (26) are extended to the antenna base (5) through the tube (15). A further antenna cable (45) leaves the tube (15) through a lateral opening (30) between the vehicle body (1) and the base plate (10), the spacing (90) between the vehicle body (1) and the base plate (10) being greater than the diameter of the further antenna cable (45). Via the recess (40), the further antenna cable (45) is passed along the retaining plate (35) and through an opening (49) of the housing (50) to reach the further antenna system (55), with which it is connected. To adapt the further antenna system (55) to the vehicle antenna (2), the retaining plate (35) needs merely to be connected to the vehicle antenna (2) and the vehicle body (1) via the tube (15). To that end, the tube (15) inside the vehicle body (1), has a male thread (70) onto which a nut (75) can be screwed.

8 Claims, 2 Drawing Sheets

VEHICLE ANTENNA ARRANGEMENT AND AUXILIARY VEHICLE ANTENNA

BACKGROUND OF THE INVENTION

The invention is based on a vehicle antenna arrangement and an auxiliary vehicle antenna.

From German Patent DE 40 05 030 C2, a vehicle antenna is already known in which an antenna base can be mounted on a vehicle body. The antenna base comprises a solid, rigid insulating material. It is secured to the body via a screw connection. The receiver connection cable is also screwed onto the antenna base.

SUMMARY OF THE INVENTION

In accordance with the present invention in a vehicle antenna arrangement a further antenna cable passes through an opening of a tube extending through a base plate which carries an antenna base and is connectable to a vehicle body, the further antenna cable passes through a recess of a retaining plate into a housing connected to the retaining plate through an opening in the housing, and the housing accommodates a further antenna system connected to the further antenna cable.

When the vehicle antenna arrangement is designed in accordance with the present invention it has the advantage over the prior art that a further antenna system can be adapted to a vehicle antenna without making an additional bore in the vehicle body. This kind of retrofit to add a further antenna system can therefore be attained inexpensively and simply. Since bores in the body are vulnerable to corrosion, one additional source of corrosion is avoided by the invention.

It can be considered a further advantage that the vehicle's value is upheld, because the antenna cable for the vehicle antenna and the further antenna system are introduced jointly through the existing bore.

An especially advantageous feature is the encasing of the housing for the further antenna system with the antenna base, because it protects the vehicle antenna arrangement against the effects of weather.

An advantage is provided with the use of the sealing gasket, since once again it protects against the effects of weather and above all prevents corrosion of the bore in the body.

Another advantage is provided with the common securing of the vehicle antenna and the further antenna system to the vehicle body, because in this way additional material and hence costs are saved.

A further advantage is provided by the fact that the base plate rests on the retaining plate via the protrusion, because in this way a defined ground contact is established.

The diameter of the further antenna cable can be less than the spacing between the vehicle body and the base plate, which has the advantage that the further antenna cable is not squeezed between the base plate and the vehicle body and is thus protected against damage.

The casing can be joined to the housing, as a result of which regions of the auxiliary vehicle antenna located outside the housing are protected against the effects of weather.

BRIEF DESCRIPTION OF THE DRAWING

One exemplary embodiment of the invention is shown in the drawing and described in further detail in the ensuing description.

DESCRIPTION OF THE PREFERRED EMBODIMENT

Figure 1:
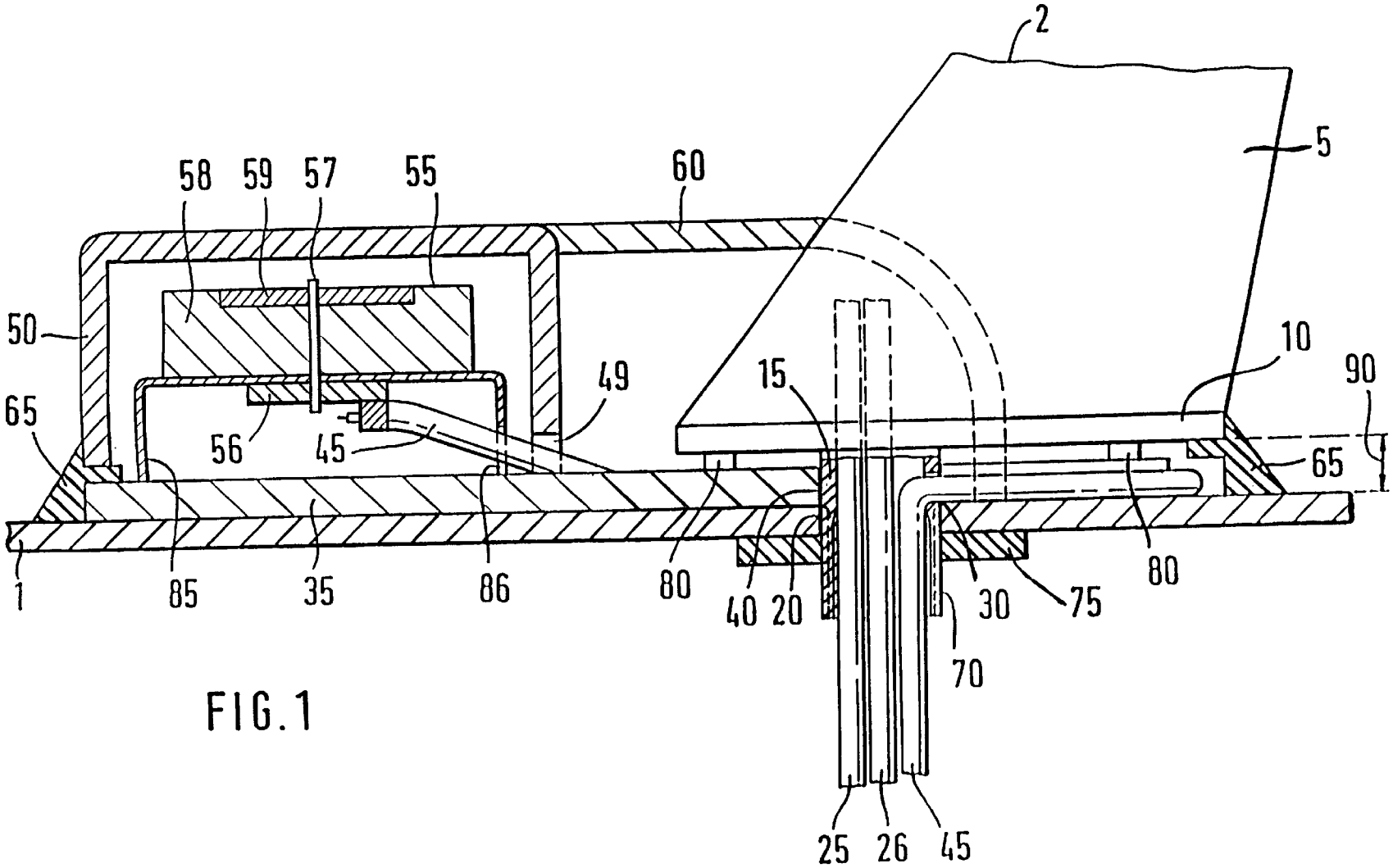
FIG. 1 is a vertical section through a vehicle antenna arrangement, comprising a vehicle antenna and an auxiliary vehicle antenna.
Figure 2:
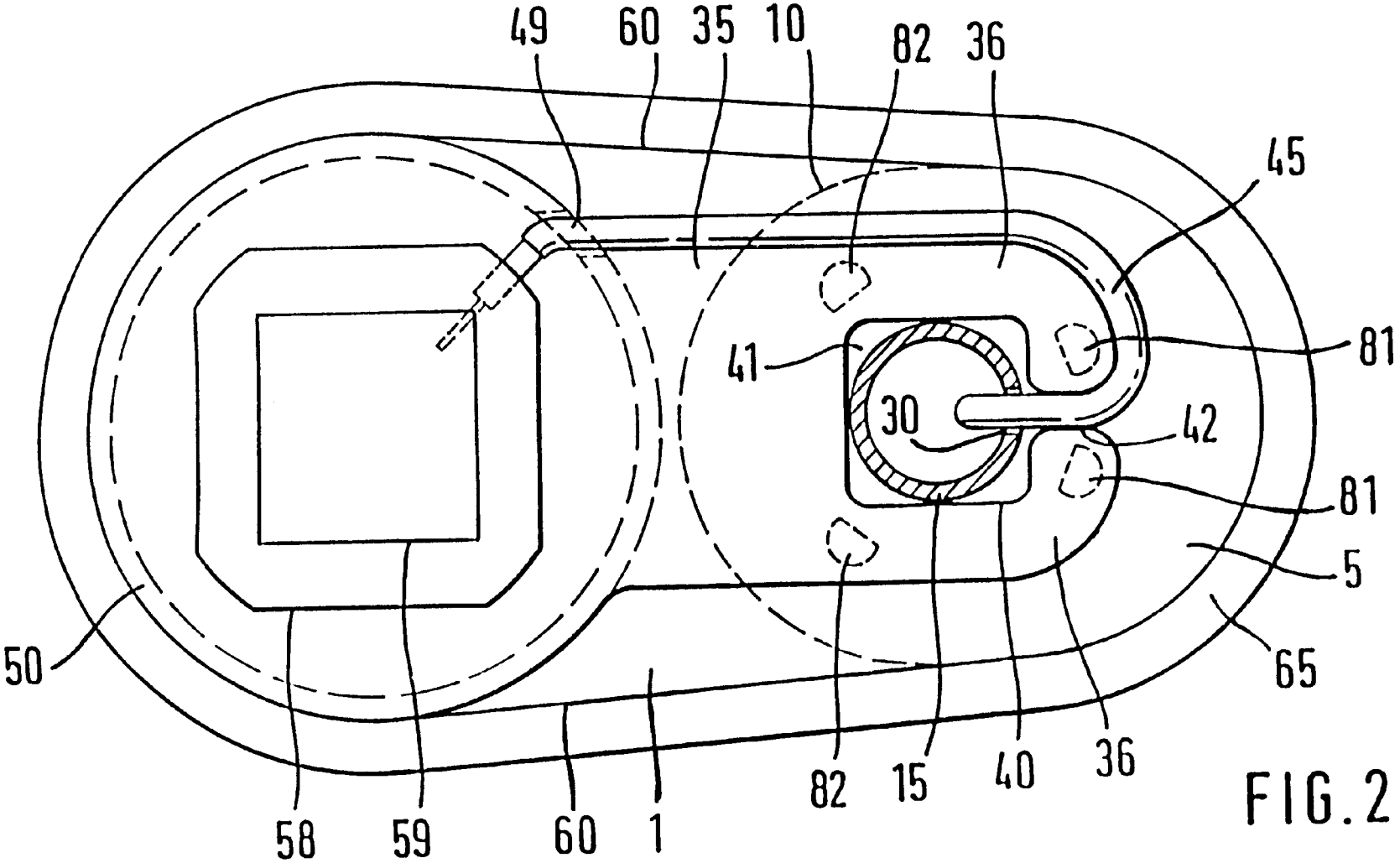
FIG. 2 shows a plan view of the vehicle antenna arrangement.

In FIG. 1, reference numeral 1 indicates a vehicle body. The vehicle body has an aperture 20 through which a tube 15 of circular cross section is extended. The tube 15 is extended outside the vehicle body through a base plate 10 with which it forms a structural unit. The antenna base 5 of a vehicle antenna 2 is mounted on the base plate 10. The tube 15, base plate 10 and antenna base 5 may for instance all comprises a single cast part. Inside the vehicle body 1, the tube 15 has a male thread 70. Via a nut 75 that can be screwed onto the male thread 70, the vehicle antenna 2 can be secured to the vehicle body 1. A first and second antenna cables 25 and 26 are passed through the tube 15 to the antenna base 5. By way of example, the first antenna cable 25 serves the purpose of radio reception, while the second antenna cable 25 is intended for the mobile radio telephone, for instance. In this case, the vehicle antenna 2 would accordingly be used for both radio reception and for the mobile phone. On its side toward the vehicle body 1, the base plate 10 has protrusions 80, which rest on a retaining plate 35 mounted between the base plate 10 and the vehicle body 1. The retaining plate 35 belongs to an auxiliary vehicle antenna, which includes a further antenna system 55, for instance for receiving GPS signals. The further antenna system 55 is accommodated in a housing 50, which is joined to the retaining plate 35, for instance by screw connections. Inside the housing 50, a mount 85 is connected to their retaining plate 35. The antenna system 55 is secured to the mount 85. The antenna system comprises an antenna chip 59, which is embedded in a dielectric 58 and communicates via a contact pin 57 with a printed circuit board 56 also secured to the mount. A further antenna cable 45 leads from the interior of the vehicle body 1 into the tube 15 and leaves the tube 15 through a lateral opening 30 outside the vehicle body 1 at the level of the retaining plate 35. The diameter of the further antenna cable 45 is less than the spacing 90 between the base plate 10 and the vehicle body 1. The spacing 90 between the base plate 10 and the vehicle body 1 is composed of the height of the protrusions 80 and the thickness of the retaining plate 35. The lateral opening 30 of the tube 15 is located on the side of the tube 15 remote from the housing 50. There, the retaining plate 35 has a recess 40 in which the further antenna cable 45 is placed. The recess 40 is shown in plan view in FIG. 2. It has a square part 41 for receiving the tube 15 and an entrance 42 at the lateral opening 30 of the tube 15 for receiving the further antenna cable 45 extended out of the tube 15. On the side of the tube 15 remote from the housing 50, the retaining plate 35 has two bearing faces 81, symmetrical to the sectional plane of the vertical section of FIG. 1, in order to support protrusions 80 of the base plate 10. The same is true of two bearing faces 82 on the side of the recess 40 toward the housing 50. For the sake of clarity, FIGS. 1 and 2 are no shown coincident. In FIG. 2 it can be seem that the housing 50 has a circular cross section, and the antenna base 5 has an oval cross section. The retaining plate 35 forms the bottom face of the housing 50 and protrudes outward under the housing 50, on the side of the housing 50 toward the antenna base 5, with a width that is less than the diameter of the bottom face of the housing 50 and is also less than the width of the base plate 10. On the side of the tube 15 remote from the housing 50 as well, the retaining plate 35 remains within the dimensions of the base plate 10. Because of the above-described recess 40, which comprises the entrance 42 and the square part 41, the retaining plate 35 in the region of the tube 15 forms two legs 36 that embrace the tube 15. The further antenna cable 45 leaves the tube 15 through the lateral opening 30, is extended through the entrance 42 of the recess 40, and finally extends, resting on the vehicle body 1, along the retaining plate 35 between the outer edge of the retaining plate 35 and the outer edge of the base plate 10, until because of the oval shape of the base plate 10 it extends underneath the base plate and is carried through an opening 49 of the housing 50 into the housing 50, where it passes through an opening 86 in the mount 85 to reach the printed circuit board 56, with which it is connected. The connection to the antenna chip 59 is then made via the contact pin 57. To protect against the effects of weather, the opening 49 of the housing 50 can also be sealed off. The housing 50 is joined to the antenna base 5 via a casing 60. The casing 60 rests on the vehicle body 1 at a tangent to the bottom face of the housing 50 and to the base plate 50, so that the part of the further antenna cable 45 and of the retaining plate 35 located between the antenna base 5 and the housing 50 is located inside the casing 60 and is thus protected against the effects of weather. A sealing gasket 65 is also provided, which is extended around the antenna base 5, casing 60 and housing 50 and rests on the vehicle body 1.

The invention described enables simple retrofitting to add a GPS antenna, for instance, by adapting it to an existing vehicle antenna 2. First, only the vehicle antenna 2 is nonpositively connected to the vehicle body 1 by the nut 75 screwed onto the male thread 70; the protrusions 80, by their contact with the vehicle body 1, assure a defined ground contact. For retrofitting to add the GPS antenna, the vehicle antenna 2 is removed from the vehicle body by loosening of the nut 75. Next, the housing 50 with the retaining plate 35 is placed on the vehicle body 1 in such a way that the recess 40 is located above the aperture 20 in the vehicle body 1. Next, the further antenna cable 45 is extended as described along the retaining plate 35 as far as the recess 40 and from there is inserted into the lateral opening 30 of the tube 15. Next, the tube 15 via the recess 40 is again inserted through the aperture 20 in the vehicle body 1, and by screwing the nut 75 onto the male thread 70 the vehicle antenna 2, retaining plate 35 and vehicle body 1 are nonpositively connected to one another. The further antenna cable 45 then merely needs to be extended in the interior of the vehicle body 1 as far as the appropriate receiver and connected there. Finally, the housing 50 is also connected to the antenna base 5 by means of the casing 60, and the sealing gasket 65 is laid around the antenna base 5, casing 60 and housing 50, so that the vehicle antenna 2, the auxiliary vehicle antenna, and the aperture 20 of the vehicle body 1 are effectively protected against the effects if aging.

I claim:

1. A vehicle antenna arrangement, comprising an antenna base mountable on a vehicle body; a base plate on which said antenna base is mounted and which is connectable to the vehicle body; a tube extending through said base plate; at least one antenna cable carried to said antenna base through said tube, said tube on a side of said base plate which is remote from said antenna base having a lateral opening; a retaining plate provided under said antenna base and having a recess at a level of said opening of said tube, said tube extending through said recess of said retaining plate; at least one further antenna cable passing through said opening of said tube via said recess of said retaining plate; a housing connected to said retaining plate and having a further opening so that said further antenna cable passes into said housing through said further opening, said housing including a further antenna system with which said further antenna cable is connected.

2. A vehicle antenna as defined in claim 1, and further comprising a casing joining said housing to said antenna base, said further antenna cable extending inside said casing.

3. A vehicle antenna as defined in claim 2, and further comprising a sealing gasket located around said antenna base, said casing and said housing and adapted to rest on the vehicle body.

4. A vehicle antenna as defined in claim 2, wherein said base plate on a side remote from said antenna base has protrusions resting on said retaining plate.

5. A vehicle antenna as defined in claim 2, wherein said further antenna cable has a diameter which is less than a spacing between the vehicle body and said base plate.

6. An auxiliary vehicle antenna for adaptation to a vehicle antenna having a tube provided with a tube opening, comprising a housing having an opening; a further antenna system accommodated in said housing; a retaining plate joined to said housing and having a recess alignable with the tube of the vehicle antenna; an antenna cable passing via said recess and said opening into said housing, said antenna cable being insertable in said tube opening.

7. An auxiliary vehicle antenna as defined in claim 6; and further comprising a casing for covering regions of the auxiliary vehicle antenna located outside of said housing, said housing being joined to said casing.

8. A vehicle antenna arrangement, comprising an antenna base mountable on a vehicle body; a base plate on which said antenna base is mounted and which is connectable to the vehicle body; a tube extending through said base plate; at least one antenna cable carried to said antenna base through said tube, said tube on a side of said base plate which is remote from said antenna base having a lateral opening; a retaining plate provided under said antenna base and having a recess at a level of said opening of said tube, said tube extending through said recess of said retaining plate; at least one further antenna cable passing through said opening of said tube via said recess of said retaining plate; a housing connected to said retaining plate and having a further opening so that said further antenna cable passes into said housing through said further opening, said housing including a further antenna system with which said further antenna cable is connected, said tube having a thread; and a nut screwed onto said thread and adapted to nonpositively connect said base plate and said retaining plate to the vehicle body.

* * * * *